United States Patent [19]

Hendrickson et al.

[11] 3,990,663

[45] Nov. 9, 1976

[54] PEDESTAL BASE SYSTEM FOR FURNITURE

[75] Inventors: Philip J. Hendrickson; Richard J. Resch, both of Green Bay, Wis.

[73] Assignee: Krueger Metal Products, Inc., Green Bay, Wis.

[22] Filed: Apr. 23, 1975

[21] Appl. No.: 570,915

[52] U.S. Cl. ..... 248/188.7; 248/165; 403/364

[51] Int. Cl.[2] ..... F16M 11/20

[58] Field of Search ..... 108/64, 150, 153; 211/177, 186, 188, 189, 194; 248/48, 150, 163, 164, 165, 188, 188.1, 188.7, 159, 188.91, 529, 533; 297/442; 403/364, 389, 390

[56] References Cited

UNITED STATES PATENTS

| | | | |
|---|---|---|---|
| 1,738,276 | 12/1929 | Barney | 248/165 |
| 1,864,535 | 6/1932 | Hach et al. | 248/188.7 X |
| 2,410,330 | 10/1946 | Ashenfelter | 108/153 X |
| 2,467,080 | 4/1949 | Duer | 248/188.1 X |
| 2,474,318 | 6/1949 | Molla | 248/165 X |
| 3,032,307 | 5/1962 | Nelson et al. | 248/188.7 |
| 3,164,347 | 1/1965 | McMasters | 248/188.1 X |
| 3,167,291 | 1/1965 | Maguire | 248/188.1 |
| 3,207,462 | 9/1965 | Zimmerman | 248/188.7 |
| 3,521,579 | 7/1970 | Stafford | 108/153 X |
| 3,537,670 | 11/1970 | Dionne | 248/188.7 |

FOREIGN PATENTS OR APPLICATIONS

| | | | |
|---|---|---|---|
| 155,256 | 2/1954 | Australia | 248/163 |
| 110,486 | 5/1940 | Australia | 248/188.7 |
| 1,513,248 | 1/1968 | France | 108/153 |
| 597,465 | 10/1958 | Italy | 108/153 |
| 295,568 | 4/1932 | Italy | 108/153 |

*Primary Examiner*—Lawrence J. Staab
*Attorney, Agent, or Firm*—Wheeler, Morsell, House & Fuller

[57] ABSTRACT

Disclosed herein is a pedestal base system for furniture in which base portions formed of pairs of duplex legs are easily assembled in interlocking splined fashion to form various base configurations for different articles of furniture. The vertical runs of each leg in a pair are welded to connctor tubes with the vertical axes of the connected vertical runs and tubes being in the same plane. The connector diameter and the diameter of the vertical tubular runs are dimensioned so that the legs in each leg pair are spaced from the legs in the other pair to provide clearance to facilitate assembly. The connector tubes of each leg pair are at a different vertical height and receive a vertical locking bolt or locking tube to secure the leg pairs in assembly. The leg pairs are easily assembled at the site by sliding the pairs together in the manner of a splined connection. Washers secured to the connector tubes by the locking bolts have four concave recesses complementary in shape to the legs to secure the legs in proper orientation with solid nesting.

7 Claims, 7 Drawing Figures

PEDESTAL BASE SYSTEM FOR FURNITURE

SUMMARY OF INVENTION

The invention provides a pedestal base system which includes base components usable in various combinations to provide bases for tables of different size and shape. The components include leg pairs separated by vertical tubular connectors which assemble axially with a second pair at right angles. The connectors and the diameter of the vertical runs of the leg pairs is such that the legs in one pair are spaced from the legs in the other interlocked pair. This provides a sturdy base with the leg pairs easily assembled by sliding one leg pair over the other into a splined fit. One leg pair of each leg set can have a shorter vertical run for connection to a stretcher between two spaced leg sets. A table can be provided with two leg assemblies with each leg assembly having two or three ground engaging legs interconnected by a stretcher.

Further objects, advantages and features of the invention will become apparent from the following disclosure.

DESCRIPTION OF PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
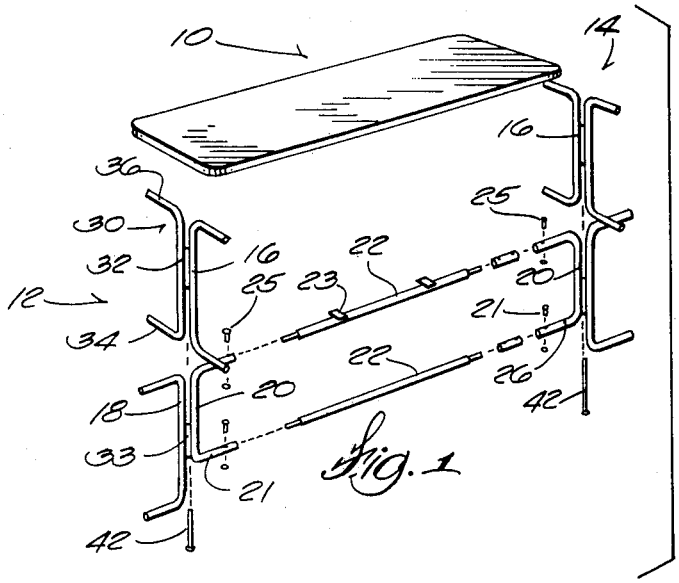
FIG. 1 is an exploded perspective view of a table including pedestal base assemblies interconnected by a stretcher in accordance with the invention.

In the drawings, FIG. 1 shows a table top 10 supported by two leg sets 12 and 14. Each leg set 12 and 14 includes a leg pair 16 and a leg assembly 18. The leg assemblies 18 include a U-shaped stretcher leg 20 with laterally extending portions 21. The portions 20 are connected to horizontally extending members 22. Splices 24 interfit in the ends 26 of the portions 21 and are bolted or otherwise secured by fasteners 25. The upper member 22 can be provided with brackets 23 for connection to the table top 10.

Figure 5:
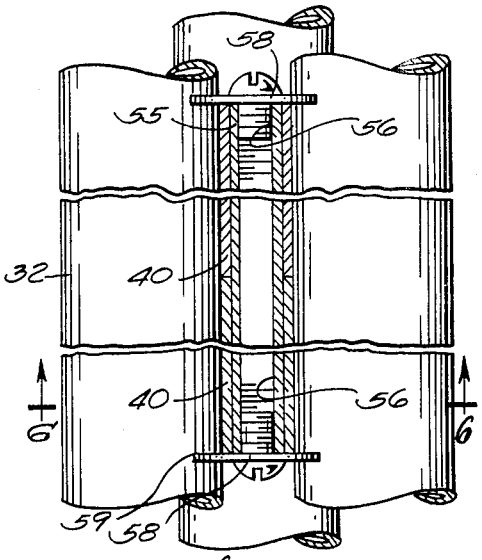
FIG. 5 is a fragmentary partial sectional view of a tubular connector for the leg pairs in a leg set.
Figure 2:
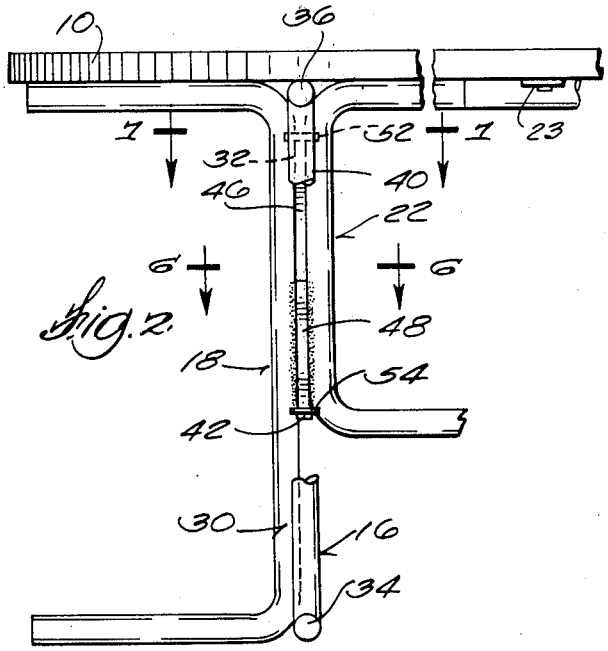
FIG. 2 is an enlarged fragmentary side elevational view of the table shown in FIG. 1.
Figure 6:
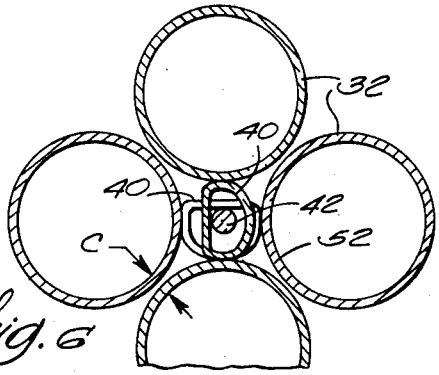
FIG. 6 is an enlarged fragmentary sectional view along line 6—6 of FIG. 2.
Figure 7:
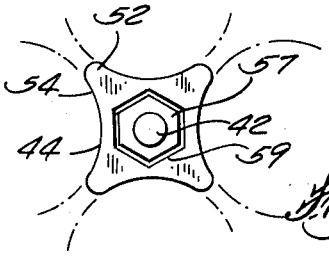
FIG. 7 is an enlarged view along line 7—7 of FIG. 2 of the shaped washer.

The leg pairs 16 include legs 30 which have vertical runs 32 with horizontally or laterally extending foot portions 34 and laterally extending table connecting portions 36. The portions 36 can be secured to the table top 10. As best shown in FIGS. 2 and 5, the vertical runs 32 of legs 30 and vertical runs 33 of the stretcher connectors 20 are welded or otherwise secured to connector tubes 40. A plane through the axes of both vertical runs in a leg pair 16 or leg assembly 18 intersects the connector tubes 40. The tubes 40 can be circular or rectangular in cross section. The preferred cross section is "D" shaped as shown in FIG. 6. The D shape can be formed by rolling a flat on cylindrical tube stock. Thus, the tube has two transverse axes of different dimensions to provide the selected clearance "C" between adjacent legs. A clearance of 1/16 to 3/32 provides adequate clearance for ease in assembly of the leg pairs.

The leg pairs are secured at the proper spacing and orientation by washers 52 (FIG. 6,7) which can be provided with arcuate recesses 54 complementary to the radius of the vertical runs. The washers 52 are desirably constructed of pliable or yieldable material such as nylon to provide solid nesting between the legs.

Bolts 42 extending through the connector tubes 40 secure the leg pairs and leg assemblies against vertical displacement. As shown in FIG. 2, the connector tube 46 is located above the connector tube 48 and the bolt 42 extends through both the tubes and is secured by a nut 57. The washer 52 adjacent the nut 57 can be provided with a hexagonal recess 59 to lock the nut 57 against rotation.

FIG. 5 shows an alternate arrangement for connecting the connector tubes 40. An inner tube 55 telescopes within the upper and lower connector tubes 40. The tube 54 is provided with internal threads 56 at both ends to receive bolts 58. Washers 52 are also employed.

Figure 3:
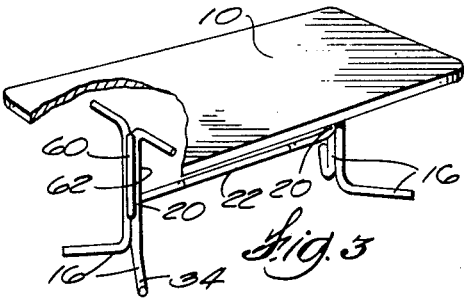
FIG. 3 is a perspective view of a modified embodiment of the invention.
Figure 4:
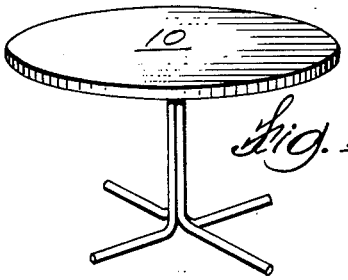
FIG. 4 is a perspective view of a further modified embodiment of the invention.

FIGS. 1, 3 and 4 show various combinations of base components in accordance with the invention. In FIG. 3, only two full length leg pairs 16 are employed in connection with a stretcher. A cafeteria table such as shown in FIG. 3 could alternatively use two leg sets shown in FIG. 4. In the FIG. 3 embodiment the stretcher connectors 20 also have spacer tubes 40 with the spacer tubes of the leg pairs 16 connected to the spacer tubes 40 of the stretcher connectors 20 as shown in either FIG. 2 or FIG. 5. A short decorative leg 60 is employed and secured by a spacer to the stretcher leg 62. The short leg 60 thus enables use of the washers 52 to assemble the legs as previously described.

We claim:

1. A pedestal base system for furniture comprising first and second leg pairs, each of said legs in said first and second pairs having spaced vertically extending runs and a first laterally extending run, tubular connectors fixed to and connecting said vertical runs of each pair and spacing said vertical runs in each pair from the surfaces of the vertical runs of said other pair to afford axial assembly of said leg pairs and wherein the vertical axes of said vertically extending runs of each pair are in a plane which intersects its respective connector and including spacing means for securing said leg pairs in assembly and maintaining each of said leg pairs in a fixed orientation and spacing with respect to each other with said vertical runs of each leg pair spaced from the vertical runs of an adjacent leg pair, said spacing means comprising washers at the upper and lower ends of the tubular connectors having peripheral recesses to afford nesting of the washers between the assembled leg pairs and which embrace and receive said surface portions of the vertical runs of each leg pair and prevent translatory displacement of said leg pairs and means extending through said washers and said connectors and securing together the connectors of the leg pairs.

2. A pedestal base system in accordance with claim 1 wherein said vertical runs of said leg pairs have a round cross section and said washers having four arcuate recesses having surfaces complementary to the surface configuration of said legs to receive said legs.

3. A pedestal base system in accordance with claim 1 wherein one of said legs in said second pair has a vertical run of a length less than other of said vertical runs, and wherein said one leg has a second laterally extending run, and a stretcher assembly connected to said laterally extending runs of said one of said legs.

4. A pedestal base system in accordance with claim 3 wherein said stretcher assembly includes two horizontal members and means for connecting said horizontal members and said laterally extending runs of said one leg.

5. A pedestal base system in accordance with claim 2 wherein said connector of one of said interlocking pairs is located above the connector of said other pair and said spacing means includes a tube having internally threaded openings, said tube extending through said connectors and bolts threadably received in said tube for securing said washers to said tube and said connectors.

6. A pedestal base system in accordance with claim 1 wherein said connectors have two transverse axes with one axis being of a length greater than said other axis with said connectors of assembled leg pairs having the longer axes oriented at 90° with respect to each other to space the leg pairs.

7. A pedestal base system for furniture comprising first and second bases each of said bases having leg pairs, each of said legs in said first and second leg pairs having spaced vertically extending runs, one of said legs in each pair having a shorter vertical run than the other leg in the pair, said shorter legs having laterally extending runs, tubular connectors fixed to and connecting said vertical runs of each pair and spacing said vertical runs in each pair and wherein the vertical axes of said vertically extending runs of each pair are in a plane which intersects its respective connector to afford axial assembly of said leg pairs and including spacing means for securing said leg pairs in assembly and maintaining each of said leg pairs in a fixed orientation and spacing with respect to each other with said vertical runs of each leg pair spaced from the vertical runs of an adjacent leg pair, stretcher connectors extending between the bases, means connecting the stretcher connectors to said laterally extending runs to provide an integrated base assembly, and means extending through and securing together the connectors of the leg pairs.

* * * * *